United States Patent [19]

Larson

[11] Patent Number: 4,522,273

[45] Date of Patent: Jun. 11, 1985

[54] DRILLING RIG

[76] Inventor: Leslie N. Larson, P.O. Box 334, Mabel, Minn. 55954

[21] Appl. No.: 260,045

[22] Filed: May 4, 1981

[51] Int. Cl.[3] ..... E21B 3/02; E21B 7/20

[52] U.S. Cl. ..... 175/135; 175/171; 173/132; 173/134

[58] Field of Search ..... 175/173, 170, 189, 55, 175/135, 171; 173/105, 49, 132, 134, 125, 128

[56] References Cited

U.S. PATENT DOCUMENTS

| | | | |
|---|---|---|---|
| 3,645,343 | 2/1972 | Mays | 175/171 |
| 3,833,072 | 9/1974 | Back | 175/85 |
| 3,845,828 | 11/1974 | Taylor et al. | 175/171 |
| 3,869,003 | 3/1975 | Yamada et al. | 175/171 |
| 4,135,585 | 1/1979 | Wagner | 173/49 |
| 4,232,752 | 11/1980 | Hauk et al. | 175/135 |

*Primary Examiner*—James A. Leppink
*Assistant Examiner*—Hoang C. Dang
*Attorney, Agent, or Firm*—Lawrence M. Nawrocki

[57] ABSTRACT

An improved drilling rig is the subject of this application. The rig includes a drilling tower (10) having a ram (16) for applying down pressure to a length of drill rod (12). A lever member (42) is suspended from the ram (16) and permitted to float toward and away from the ram (16) by being mounted for movement along tracks provided by a plurality of eyes (50) elongated in directions toward and away from the ram (16). Suspension bolts (52) extending through the eyes (50) at one end (72) of the lever member (42) are allowed to ride upwardly to the upper extremity of the eyes (50) to form a point about which the lever member (42) pivots. A percussion assembly (26) includes a piston (34) which percussively engages the lever (42) at its opposite end (70). The percussion assembly (26) is laterally off-set from the axis of the drill rod (12). The percussive force imparted to the lever member (42) is translated to the upper end (30) of casing (28) encircling the drill rod (12).

16 Claims, 9 Drawing Figures

FIG. 5
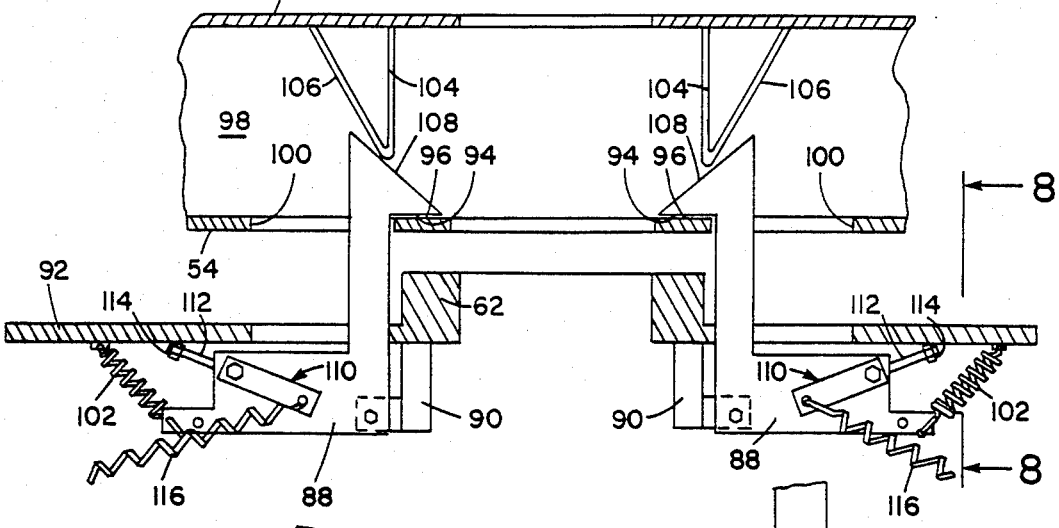
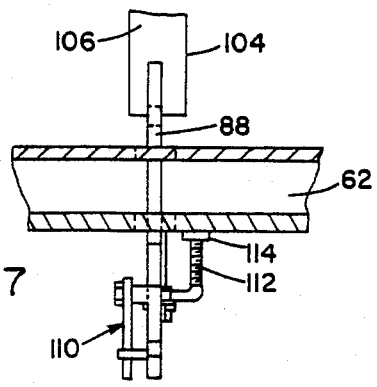
FIG. 7
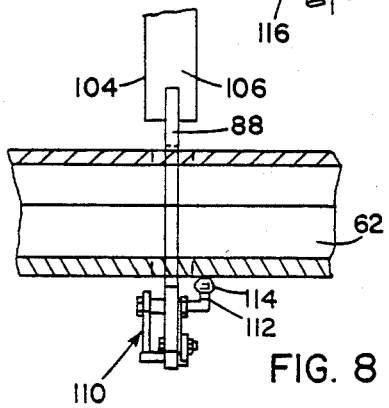
FIG. 8
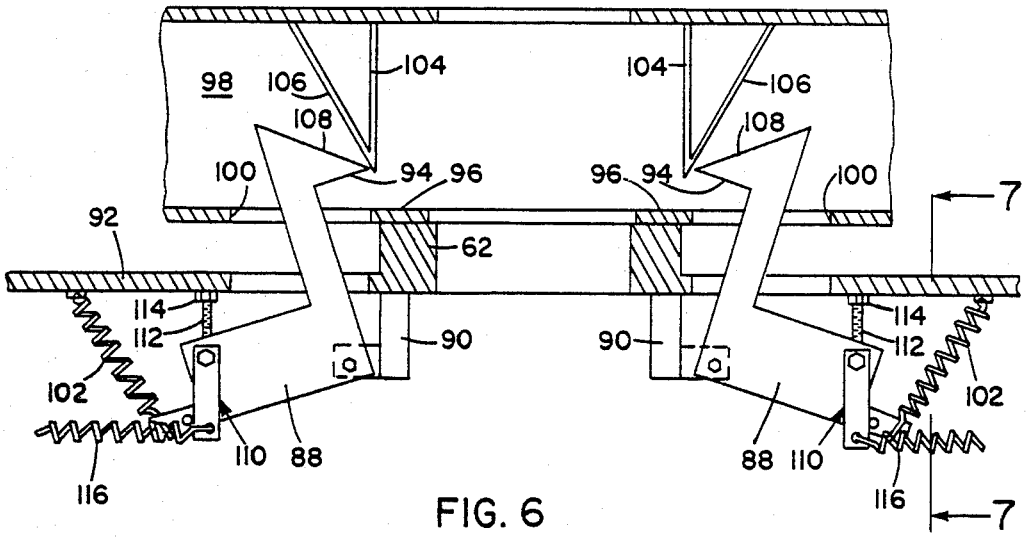
FIG. 6

DRILLING RIG

TECHNICAL FIELD

The invention of the present application deals broadly with drilling rigs, and especially rigs of the type used for drilling wells for rural residences. More specifically, it is related to top-of-the-hole rigs which are utilized for both driving a drill bit in its rotational motion about a generally vertical axis and driving casing, concentrically enclosing the drill rod, vertically down into the hole drilled. In a preferred embodiment, structure is provided which allows greater lengths of additional drill rod and casing to be attached to the driven string of drill rod, and which more effectively drives the casing into the ground.

BACKGROUND OF THE INVENTION

Drilling rigs are put to various commercial applications. Typical of these applications are oil exploration, commercial well drilling, etc.

Within the commercial well drilling application, a number of types of drills are utilized. A first type, the most basic type, includes a joint or string of joints, of drill rod having a bit mounted at the bottom end thereof. The drill rod is mounted to a ram, or tophead, which applies down pressure to the drill rod string as it rotates to effectuate the drilling function. With this type of rig, the hole is made as a result of the down pressure force applied by the ram and the abrasion applied to the ground as a result of the rotation of the bit. Cuttings, or particulate matter created by the abrasion of the bit against the ground, are blown out of the hole by a source of high pressure air channeled to the bit.

As one joint of the drill rod string becomes substantially submerged beneath the level of the ground with only the portion of the joint which is attached to the tophead extending above the level of the ground, an additional joint is attached. The upper end of the substantially submerged joint is detached from the tophead and the tophead raised to a level so that an additional joint can be interposed. The lower end of the interposed joint is married to the upper end of the previous joint and its upper end is fixedly attached to the ram to complete the rig.

A second type of rig provides means for not only rotating the bit and applying a constant down pressure, but it also includes a means for applying cyclic percussion to the bit to cause it to cyclically impact against the ground engaged by the bit to effectuate better drilling, particularly when the ground being worked is hard or rocky. Typically, a percussion assembly having a hammer for applying the percussive force is mounted at the bottom of the drill rod string. The assembly is arranged, with respect to the bit, so that the hammer impacts upon the upper end of the bit. High pressure air lines pass through the drill rod string to control actuation and deactuation of the hammer. This type of rig is referred to as a bottom-hole rig.

A third type of rig is one in which this cyclical percussive force is applied to the drill rod string above the surface of the ground. Typically, this type of rig is referred to as a top-of-the-hole rig.

Under certain circumstances, percussion drilling is used in ground composed of soft materials. These materials can fall from the sides of the drilled hole as the drill rod is withdrawn therefrom. This can prove to be counter-productive. The hole can become filled with the loose materials so that the effect of the drilling is, to some degree, negated. This problem can be overcome by simultaneously inserting a casing within the hole and around the drill string to support the inner surface of the hole. With the casing serving as an inner retaining wall, when the drill rod and bit assembly are withdrawn, cuttings will not fill the hole.

Some drilling rigs known in the art provide structures which effectuate both application of the cyclic percussive force to the drill bit and percussive force to the upper end of the casing to drive it down in the hole around the drill rod string. In most of such devices, however, separate assemblies are used to effectuate each of these percussion application funtions. Such devices tend to be larger, more complicated, and consequently, more expensive to manufacture.

In all structures known in the prior art wherein a percussion assembly is utilized to apply percussive force to either or both of the drill bit and casing, the force is applied substantially coaxially with the drill rod string and the casing. The force is, thereby, applied on a 1:1 relationship from the percussion assembly to either the drill bit or casing with some measure of attenuation due to friction. The percussive force applied to either the drill bit or casing, therefore, is limited to the amount of force capable of being generated by the percussion assembly.

An additional problem with drilling rigs utilizing percussion assemblies results from the axial length of the assemblies used. The assembly is interposed in series with the ram, aligned in the direction in which down pressure is applied. When the ram is retracted, therefore, to an upper extremity of the drill tower by which the constant down pressure is applied to it, the length of additional joints of drill rod which can be interposed is limited because of the additional length introduced by the percussion assembly.

It is to these problems that the invention of the present application is directed. It provides a drilling rig which both allows longer segments of drill joints to be added as new rod is needed. Time and expense of the driller are thereby minimized. Simultaneously, it provides a structure which can amplify the percussive force applied to the casing by a percussion assembly.

SUMMARY OF THE INVENTION

The present invention is an apparatus for use with a drilling rig including a length of drill rod having one or more joints of rod in the string. Typically, the drill rod is mounted, at one end, to a drilling tower and has a bit element attached at its opposite end. The tower, by means of a ram, or top head, imparts linear axial force to the drill rod so that the bit is made to engage a ground surface. Rotational movement about its axis of elongation is also imparted to the drill rod. The rotation of the bit element, while it is engaging the ground surface, will cause abrasion and the forming of a hole. The application of the linear axial force to the drill rod will cause the hole to be progressively enlarged.

Typically, such drilling rigs also utilize casing which is inserted into the hole formed in the ground to retain the inner wall of the hole. Consequently, the axial length of the casing is generally coextensive with the length of the drill rod. It is particularly desirable to have the casing concentrically encircled the drill rod.

The invention of the present application is a device for driving the casing into the hole by application of cyclical percussive force to the end of the casing extending out of the hole. It includes a percussion assembly mounted to the drilling tower. The assembly has, as an element, a piston which, by use of high pressure air or other appropriate fluid, can be made to reciprocate rapidly. The piston is positioned at a location spaced laterally from the axis of the drill rod, and it is made to reciprocate cyclically in directions parallel to the axis of the drill rod. The device further includes a rigid lever member which is normally oriented generally perpendicular to the drill rod axis. It is mounted by a first end, on one side of the drill rod, for pivoting movement. Its second end is disposed on a diametrically opposite side of the drill rod. It is either apertured or bent to accommodate the run of the drill rod. It is mounted to the tower, and the linear force applied to the drill rod is also applied to it. The second end of the lever member is positioned closely proximate the piston of the percussion assembly so that an anvil surface of the member can be struck by the piston as it reciprocates. The invention further includes a percussion transmission element which is disposed axially between the lever member and the casing. The transmission element has a first shoulder which is engaged by the lever member. A second shoulder of the element engages the end of the casing which extends out of the hole being formed. The transmission element can, thereby, relay the percussive force applied by the lever to the casing.

In a perferred embodiment, the transmission element can be detachably latched to the lever member. With the elements so cooperating, the transmission element can be raised upwardly with the lever member and ram, or top head, when it is necessary to insert additional lengths of drill rod and casing.

Certain operations of the drilling rig require retraction of the drill rod a small distance within the hole in order to blow out ground cuttings built up within the casing. It is desireable to direct these cuttings in a particular direction and restrict their disbursal. This can be accomplished by providing that the transmission element be detachable from the lever member when desired. In a preferred embodiment, the transmission element can include a discharge opening formed in its wall. As cuttings are blown up within the casing, they will pass axially into the transmission element and through the discharge opening provided.

In order to ensure that, when the lever member is withdrawn from engagement with the transmission element as the drill rod is retracted within the hole, cuttings blown up within the casing do not disburse through an annular space between the drill rod and the transmission element, sealing means can be provided. Packing or other appropriate means can be inserted radially between the drill rod and the transmission element and axially between the discharge opening and the end of the element which is normally engaged by the lever member.

The invention of this application is thus an improved structure for effectuating percussive driving of casing. Its structural characteristics enable it to more efficiently effect the casing driving. Additionally, its structure affords expeditious and orderly insertion of additional drill rod and casing lengths and discharge of cuttings from the hole. Specific advantages of the invention will become apparent with reference to the accompanying drawings, detailed description of the invention, and the claims.

BRIEF DESCRIPTION OF THE DRAWINGS

FIG. 5 is an enlarged fragmentary view, in section, showing the lever member spaced axially from the percussion transmission element and with the latches in latching engagement;

FIG. 6 is an enlarged fragmentary view, in section, showing tne lever member axially engaging the percussion transmission element and with the latches laterally offset from the latching abutment of the lever member;

FIG. 7 is a view taken along the line 7—7 of FIG. 6;

FIG. 8 is a view taken along the line 8—8 of FIG. 5; and

DETAILED DESCRIPTION OF THE INVENTION

Figure 1:
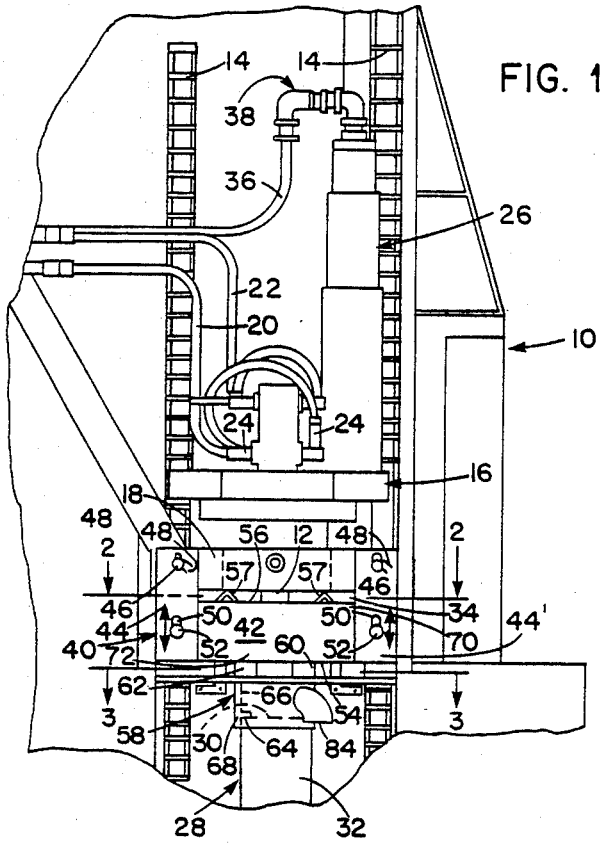
FIG. 1 is a front elevational view of a portion of a drill tower constructed in accordance with the present invention.
Figure 2:
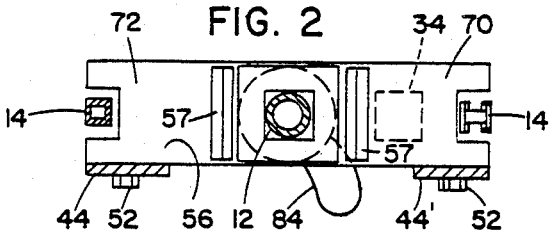
FIG. 2 is a sectional view taken along the line 2—2 of FIG. 1.

Referring now to the drawings wherein like reference numerals denote like elements throughout the several views, FIG. 1 illustrates a portion of a drill tower, generally identified by the reference numeral 10, in accordance with the invention of the present application. The tower 10 is of the type wherein constant pressure is applied axially to a length of drill rod 12, or string of axially aligned drill rod joints, having a bit element (not shown) mounted at the end of the rod length or rod string, which bit element is made to engage the ground into which a hole is to be drilled. Rotational motion is also imparted to the drill rod 12 about its axis of elongation. Abrasion of the ground surface by the bit element, as it is driven rotationally by the drill rod 12, effectuates formation of the hole.

The tower 10 includes a pair of tensioned chains 14. Each of the chains 14 is run over sprockets (not shown), one at the top and one at the bottom of the tower 10. Movement of the chains 14 over the sprockets and in directions longitudinally with respect to the tower 10 cause the down pressure to be applied to the drill rod 12. The tower 10 includes a ram 16, or top head, fixedly attached at opposite ends thereof to each of the chains 14. As down pressure is applied to the chains 14, a trunnion 18, formed at the lowermost portion of the ram 16, moves in the direction which do the chains 14.

The drill rod length or string extends axially from the trunnion 18 in the direction in which drilling is desired.

High pressure air lines 20, 22 are provided from an HP air source to the ram 16. One line provides air to effectuate the rotational movement of the drill rod 12 about its longitudinal axis. The second line provides a source of air which is channeled, through the drill rod 12, to the drill bit. This source of air is actuated when it is desired to blow cuttings formed by the drill bit out of the hole having been created. Appropriate couplings 24 are provided to connect the HP air lines to the ram 16.

The portion of the drilling rig described thus far is not, in itself, new. Drilling rigs are known in the art which accomplish drilling in the manner and by use of the structure defined. Some discussion has, however, been necessary in order to illustrate the manner in which the invention of the present application cooperates with the structure to accomplish its intended function.

The present invention includes a percussion assembly 26 for driving casing 28 into the hole drilled to form an inner retaining wall therefore. In many applications to which drilling rigs are put, it is necessary to provide such a retaining wall not only because of the end use of the drilled hole, but also because of the type of earth into which the hole is drilled. Typically, the casing 28 is driven concurrently with the drilling of the hole. A length of casing 28 is, generally, axially coextensive with a length of drill rod 12, and, as a new length of drill rod is added to the string, an additional length of casing 28, concentrically enclosing the new length of rod, is also added.

The casing 28 includes an end, proximate the bit, mounted at the end of the drill rod 12 remote from the ram 16. The opposite end of the casing 28, or the end 30 which is driven by the percussion assembly 26, is spaced from the end proximate the bit by a wall 32 defining the bore through which the drill rod 12 passes. In most cases, this wall 32 is cylindrical in cross-section.

The end 30 of the casing 28 opposite the end proximate the drill bit has percussive force applied axially thereto by the percussion assembly 26. The percussion assembly 26 includes a piston 34 mounted within the assembly housing for reciprocal movement along an axis generally parallel to the axis of elongation of the drill rod 12. An HP air source is connected to the percussion assembly, via an air conduit 36 and appropriate couplings 38, to actuate the piston 34 in its reciprocal movement.

The percussive force created by the piston 34 in its reciprocating movement is transmitted to the casing 28. This is accomplished by providing a cross member 40 extending across the upper end of the casing 28 and axially intermediate the piston 34 of the percussion assembly 26 and the casing 28.

The cross member 40 first includes a lever member 42 suspended from the trunnion 18. Two pairs of side plates 44, 44', one pair on either side of a plane defined by the tensioned chains 14, extend downwardly from the trunnion 18. One plate of each pair is disposed on either side of the drill rod string 12. Apertures are formed in the upper ends of all the plates 44, 44', and the apertures in two plates 44, 44' sandwiching a chain 14 are made to register with a similarly sized aperture formed in the trunnion 18 at one end thereof. A shaft 46 is passed through the aligned apertures, and can be passed between adjacent lengths in the chain 14 in certain embodiments, if desired, and secured in place by a cotter pin 48. The two other plates sandwiching the other chain are secured to the trunnion in a similar manner.

The lever member 42 is supported from the plates 44, 44' proximate the bottom ends thereof. Generally vertically elongated eyes 50 are provided, one in each plate, and bolts 52 are passed therethrough and threadedly received in holes provided for this purpose in the lever member 42. Since the eyes 50 are vertically elongated, the lever member 42 is free to float some distance relative to the trunnion 18. A first side 54, or lower side, of the lever member 42 faces toward the casing 28. The second side 56 faces the trunnion 18 and, when resistance is encountered by the first side 54 of the lever member 42 forcing the member 42 upwardly so that the bolts 52 passing through the elongated eyes 50 move to the upper extremities of those eyes 50, is engaged by the trunnion 18. Alignment members 57 are provided to center lever member 42 radially with respect to trunnion 18.

A percussive force transmission element 58 is positioned axially intermediate the lever member 42 and the casing 28. It includes a first shoulder 60, defined by an upwardly disposed plate 62, which is engaged by the first side 54 of the lever member 42 proximate its central portion. A second shoulder 64 formed on the generally cylindrical inner surface 66 of a casing engaging portion 68, axially engages the end 30 of the casing 28 extending out of the hole.

The piston 34 of the percussion assembly 26 is positioned so that, as it reciprocates, it engages the second or anvil side 56 of the lever member 42 proximate a second end 70 thereof. When resistance is encoutered by the first side 54 of the lever member 42, as when the casing 28 is being driven, and the lever member 42 is closed up against the trunnion 18, the piston 34, as it reciprocates, will urge the second end 70 of the lever member 42 downward rotationally about an axis of pivot passing through the suspension bolts 52 at the first end 72 of the lever member 42 as they are positioned at the upper extremities of the eyes 50 formed in the plates 44, 44'. In between the application of percussive strokes to the anvil side 56 of the lever member 42, the second end 70 of the member will be pivoted back upwardly until the suspension bolts 52 at the second end 70 of the lever member 42 engage the upper extremities of the eyes 50 and the lever member 42 is, along its length, engaged by the trunnion 18.

Because of the limited length of the eyes 50, the arc through which the lever 42 will be allowed to pivot is restricted to only a small angular measure. The lever member 42 will never be able to pivot beyond a point at which the bolts 52 at the second end 70 of the member engage the lower extremities of the eyes 50 formed in the plates 44' on the right side of the tower as viewed in FIG. 1.

The advantages of the structure thus far described can readily be seen. Rather than applying the percussive force in axial alignment with the casing 28, the force is applied to the lever 42 at a location spaced laterally from where the resistance of the casing 28 is applied. Consequently, mechanical advantage can be obtained.

Figure 4:
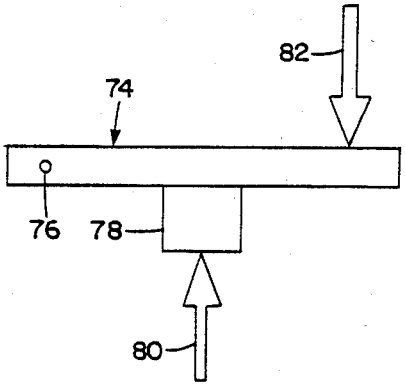
FIG. 4 is a diagrammatic view illustrating the operation of the lever member.
Figure 3:
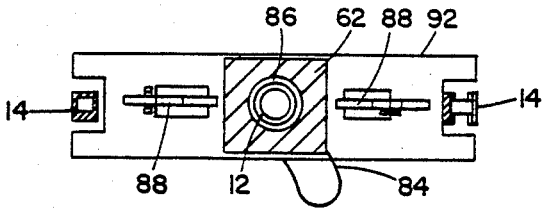
FIG. 3 is a sectional view taken along the line 3—3 of FIG. 1.
Figure 9:
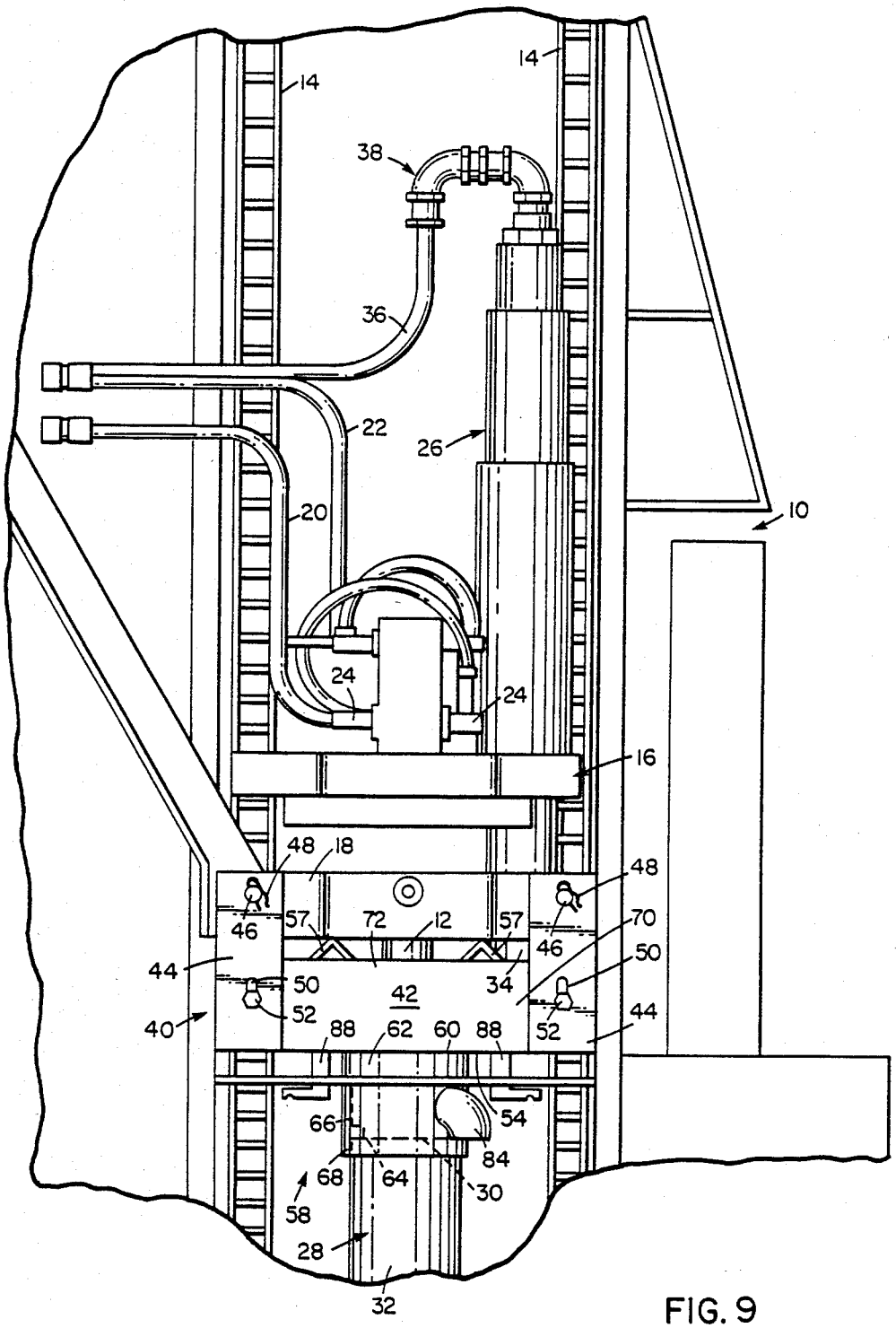
FIG. 9 is an enlarged view identical to FIG. 1.

The lever member 42 of the drilling rig illustrated in FIG. 1 essentially functions as a second class lever. Operation of the lever member is illustrated diagrammatically in FIG. 4. Reference numeral 74 represents the lever member as mounted for pivotal rotation about a pivot point 76. A box 78 represents the casing, and a first arrow 80 represents the application of the resistance offered by the casing. A second arrow 82 represents the percussive force applied to the lever member. In this figure, the advantage of laterally displacing the point of application of the percussive force can more easily be seen.

Additional advantages can be obtained by laterally off-setting the percussion assembly 26 from the axis of elongation of the drill rod 12. As previously described, the ram 16, including the trunnion 18 is in axial alignment with the drill rod 12. Portions of the ram 16, including some component of the length of the air hoses 20, 22 and attachment couplings 24, extend even farther axially in alignment with the drill rod 12. In some rigs known in the art, the percussion assembly 26 is axially aligned with the drill rod 12. With such structures, the axial dimensions of the percussion assembly 26, the ram 16, and its related HP air hoses 20, 22 and attachment couplings 24 are additive. Since the height of the tower 10 is limited, and the ram 16 can be raised only to a height at which the uppermost extremity of any component attached to the ram 16 engages the upper end of the tower 10, the length of drill rod and casing that can be added during drilling operations is somewhat limited. By off-setting the percussion assembly 26 so that it is essentially in parallel with the ram 16 rather than in series, the ram 16 can be raised to a higher point on the tower 10. Consequently, drill rod joints and lengths of casing having greater longitudinal dimensions can be inserted when new rod and casing is needed.

During drilling operations, it is often necessary to inject HP air down through the drill rod string 12 and out through ports formed in the bit element in order to eject ground cuttings which become deposited at the bottom of the hole. Rather than allowing these cuttings to randomly disperse out through an annular opening between the drill rod and the casing, a discharge elbow 84 extending from an opening formed in the casing engaging portion 68 of the cross member 40 can be provided. In order for the discharge elbow 84 to be effectual in accomplishing its designed function, the transmission element 58 must remain seated on the upper end 30 of the casing 28 and the annular opening between the drill rod 12 and transmission element 58 must be sealed. An appropriate type of packing 86 can be provided in the annular opening between the drill rod 12 and the upwardly disposed plate 62 of the cross member 40. With the packing 86 in this position axially intermediate the lever member 42 and the discharge opening, the cuttings will not be prevented from reaching the discharge elbow 84 but will be precluded from passing axially therebeyond.

As previously mentioned, in order for the discharge elbow 84 to be effectual, the casing engaging portion 68 must remain seated on the casing 28. When air is passed down through the drill rod string 12 to blow the cuttings out of the hole, however, it is sometimes necessary to withdraw the drill rod 12 string within the casing 28. Consequently, the transmission element 58 cannot be formed integrally with the lever member 42. If such were the case, as the lever member 42 were retracted within the casing 28, the casing engaging portion 68 would rise from the end 30 of the casing 28 extending out of the hole, and cuttings would spew out of the top of the casing 28.

When additional lengths of drill rod and casing are to be added, however, the percussion transmission element 58 must be raised upwardly on the tower along with the lever member 42. An additional length of casing can, thereby, be inserted with its upper end 30 being axially engaged by the shoulder 64 formed in the cylindrical inner surface 66 of the casing engaging portion 68.

In order to allow the transmission element 58 to be alternately fixedly connected to the lever member 42 and seated on the casing 28 even when the lever member 42 is retracted, means can be provided to detachably mate the transmission element 58 to the lever member 42. One type of structure by which this can be accomplished is illustrated in FIGS. 5 through 8. The mating means can include a latch or pair of latches 88 which are pivotally mounted to L-shaped appendages 90 extending downwardly from a member 92 having an elongation generally transverse to the axis of elongation of the drill rod string 12. Each latch 88 is provided with a latch surface 94 which can axially engage a latching abutment 96 provided in the interior 98 of the lever member 42. Apertures 100 are provided in the first side 54 of the lever member 42 to allow the latches 88, carried by the transmission element 58, to enter into the interior 98.

The latches 88 are pivotally mounted to the L-shaped appendages 90 for movement between first positions wherein the latch surfaces 94 can axially engage the latching abutments 96 of the lever member 42 and second positions wherein the latch surfaces 94 are laterally off-set from the abutments 96. When the latches 88 are in their second positions, the latch surfaces 94 cannot engage the abutments 96. Means, such as springs 102, are provided to bias the latches 88 toward their first positions.

Latch releasing ramps 104 can be provided within the interior 98 of the lever member 42. The latches 88 can extend through the apertures 100 formed in the first side 54 of the lever member 42 and, when the lever 42 is spaced axially from the upwardly disposed plate 62 of the transmission element 58, be positionable in their first positions wherein the transmission element 58 is latched to the lever 42. The relative positions illustrated in FIG. 5 are the positions in which the various elements would be disposed when additional lengths of casing and drill rod are added.

After the new casing and drill rod are inserted, the down pressure which would be applied by the ram 16 in order to reinitiate the drilling function would cause the lever member 42 to approach the transmission element 58. The ramp surfaces 106 carried within the interior 98 of the lever 42 move downwardly with respect to angled surfaces 108 on the latches 88 and urge the latches 88 outwardly. When the lever 42 is in engagement with the upwardly disposed plate 62 of the transmission element 58, the latches 88 would be urged outwardly to laterally offset positions with respect to the abutments 96 of the lever 42. With the latches 88 in these positions, the lever 42 can be withdrawn with the drill rod string, leaving the percussion transmission element 58 seated on top of the casing 28.

Keepers 110 can be provided to maintain the latches 88 in their second positions as the drill rod 12 and lever member 42 are retracted. If keepers 110 were not provided, as the lever member 42 was retracted, the latches 88 would pivot again to their first positions, thereby precluding retraction of the lever 42 independent of the transmission element 58.

Each keeper 110 can include a strut 112 pivotally mounted to one of the latches 88. The strut 112 can be pivoted in a plane generally parallel to the plane in which the latch 88 to which it is attached pivots. It is configured for movement between a position wherein a remote end 114 of the strut 112 engages the underside of the transverse elongation 92 of the cross member 40 to hold the latch 88 in its second position, and another position wherein the latch 88 is not so held. The keeper 110 is shown as being biased by spring 116 to the position wherein the strut 112 holds the latch 88 at its second position. This bias will cause the keeper 110, as the latch 88 rides up the ramp surface 106, to snap over to its retaining position. Ends of the springs 116 remote from the keepers 110 can be attached to the member having an elongation generally transverse to the axis of elongation of the drill rod.

When a length of drill rod and casing have been driven into the ground to a point at which additional lengths of casing and drill rod are necessary, the keepers 110 can be manually released when the lever 42 is in an axial position with respect to the cross member 40 so that the latch surfaces 94 of the latches 88 can engage the latching abutments 96 of the lever 42. The transmission element 58 can, thereby, be latched to the lever 42.

With the various components so attached together, they can be raised and the new length of drill rod and casing inserted. During subsequent operations, when the transmission element 58 is closed up to the lever member 42, the latches 88 will, again, automatically release to allow the transmission element 58 to remain seated on the casing 28 should it be necessary to retract the lever member 42 during cutting blowing operations.

Numerous characteristics and advantages of the invention have been set forth in the foregoing description. It will be understood, however, that this disclosure, is in many respects, only illustrative. Changes may be made in details, particularly in matters of shape, size, and arrangement of parts without exceeding the scope of the invention. The invention's scope is defined in the language in which the appended claims are expressed.

What is claimed is:

1. In combination with drilling apparatus which includes a length of drill rod having an axis of elongation and a bit element at a remote axial end thereof, a drilling tower supporting the drill rod by an end opposite the remote axial end, means carried by the tower for imparting linear axial force to the drill rod in a direction toward the end of the rod at which the bit element is mounted and rotational movement to the drill rod about its axis of elongation, and a segment of casing, similar in length to the drill rod, encircling the drill rod and having an end adjacent the bit element and an opposite end; a device for driving the casing into a hole formed by the bit element to provide an inner retaining wall therefor, comprising:

(a) a percussion assembly mounted to the tower and having a piston laterally spaced from the axis of the drill rod, said piston being disposed for rapid cyclic reciprocation along an axis generally parallel to the axis of the drill rod;

(b) a rigid lever member normally disposed generally transverse to the drill rod and extending between first and second ends, diametrically opposed about the drill rod, and around the drill rod;

(c) means pivotally mounting said member to the tower for receipt of the linear axial force and by said first end for pivoting thereabout, with said second end positioned to be strikingly engaged on an anvil side of said member by said piston as it reciprocates; and (d) a percussion transmission element disposed axially intermediate said lever member and the casing, said element having a first shoulder axially engaged by a side of said lever member facing oppositely from said anvil side and a second shoulder axially engaging the end of the casing opposite the end adjacent the bit element.

2. The combination of claim 1 wherein the means for imparting linear axial force and rotational movement to the drill rod includes a ram and axially extending air hose couplings, and wherein said percussion assembly is at least partly axially coextensive with the ram and air hose couplings.

3. The combination of claim 1 wherein said lever member is limited to pivotal movement through a restricted arc wherein it is positionable only closeby proximate a line perpendicular to the axis of elongation of the drill rod.

4. The combination of claim 3 further comprising means for detachably mating said percussion transmission element to said lever member for axial movement therewith.

5. The combination of claim 4 wherein said transmission element includes a portion elongated in a direction generally transverse to the axis of the drill rod and said lever member includes an abutment facing in an axial direction away from said transmission element, and wherein said mating means comprises a latch extending generally axially and has a latch surface facing in an axial direction opposite that in which said abutment faces, said latch being pivotally mounted to said generally transverse elongated portion for movement between a position wherein said latch surface can axially engage said abutment and a position wherein said latch surface is laterally offset from said abutment.

6. The combination of claim 5 wherein said lever member includes a pair of abutments, one on either side of the axis, and said mating means comprises a pair of latches, each operatively cooperating with one of said abutments to detachably mate said percussion transmission element to said lever member.

7. The combination of claim 6 wherein said latches are biased to said positions wherein said latch surfaces can axially engage said abutments.

8. The combination of claim 7 wherein said latches are of an axial length such that said latch surfaces can engage said abutments with said percussion transmission element spaced axially from said lever member, and wherein said combination further comprises a pair of ramp surfaces in substantial alignment axially with said latches and spaced axially a distance therefrom to urge said latches to said positions wherein said latch surfaces are laterally offset from said abutments as said lever member is made to approach said percussion transmission element.

9. The combination of claim 8 further comprising keepers carried by said transmission element and positionable to retain said latches in said positions wherein said latch surfaces are laterally offset from said abutments, against said bias, and wherein said keepers are biased to their retaining positions.

10. A drilling rig, comprising:

(a) at least one drill rod joint having an axis of elongation and a drill bit detachably mounted at one axial end thereof;

(b) means for applying linear force to said at least one joint in a direction of said axial end at which said bit is mounted, and means for imparting rotational motion thereto about said axis;

(c) at least one length of casing, said casing having a wall enclosing said drill rod and extending substantially the length of said drill rod, said wall having a bit end and an outer end;

(d) a cross member to which said linear force is applied, said member including a lever portion, having first and second ends and opposite sides, extending generally transversely to said axis and being mounted for pivoting about said first end, and a casing engaging portion, centrally between said first and second ends of said lever portion and extending axially from a first of said opposite sides thereof, axially abutting said outer end of said wall, both of said portions being apertured to permit passage of said drill rod therethrough; and (e) a percussion hammer having a piston actuable to reciprocate cyclically in an axial direction to percussively engage, at one end of its reciprocation, a second of said opposite sides of said lever portion, said piston being spaced from said axis so that said piston engages said lever portion proximate said second end thereof.

11. The rig of claim 10 wherein said casing engaging portion defines a generally cylindrical inner surface, and wherein said inner surface has formed therein an annular shoulder for abutting said outer end of said casing wall.

12. The rig of claim 11 wherein said inner surface of said casing engaging portion substantially concentrically encircles said drill rod.

13. The rig of claim 12 wherein said inner surface has formed therein a cutting discharge opening, said opening being positioned intermediate said annular shoulder and said lever portion.

14. The rig of claim 13 wherein said casing engaging portion is detachably latched to said lever portion.

15. The rig of claim 14 wherein, when said bit, while rotating, is brought to bear against a ground surface, ground cuttings are formed, and further comprising fluid means for blowing the ground cuttings outwardly through said casing.

16. The rig of claim 15 further comprising sealing means radially intermediate said drill rod and said casing and axially intermediate said discharge opening and said lever portion.

* * * * *